US006863003B2

(12) United States Patent
Grainger

(10) Patent No.: US 6,863,003 B2
(45) Date of Patent: Mar. 8, 2005

(54) PALLET SYSTEM

(76) Inventor: Allan Grainger, Oskrafe, Pan-y Darran Park, Merthyr Tydfil (GB)

( * ) Notice: Subject to any disclaimer, the term of this patent is extended or adjusted under 35 U.S.C. 154(b) by 85 days.

(21) Appl. No.: 10/358,146

(22) Filed: Feb. 5, 2003

(65) Prior Publication Data

US 2003/0146361 A1 Aug. 7, 2003

(30) Foreign Application Priority Data

Feb. 5, 2002 (GB) ..... 0202606

(51) Int. Cl.[7] ..... B65D 19/00
(52) U.S. Cl. ..... 108/51.11; 108/53.1; 108/55.1
(58) Field of Search ..... 108/53.1, 53.3, 108/53.5, 55.1, 55.5, 51.11, 102, 105, 109, 110; 211/126.15, 191, 186, 187, 94.02

(56) References Cited

U.S. PATENT DOCUMENTS

| | | | | |
|---|---|---|---|---|
| 1,891,394 A | | 12/1932 | Otte | |
| 2,577,276 A | * | 12/1951 | Saul, Jr. | 108/53.1 |
| 3,053,403 A | * | 9/1962 | Barton | 108/53.5 |
| 3,209,711 A | * | 10/1965 | Pope | 211/126.15 |
| 3,664,716 A | | 5/1972 | Johnson | |
| 3,677,615 A | | 7/1972 | Hudson | |
| 4,258,631 A | * | 3/1981 | Brown | 108/53.5 |
| 4,334,715 A | | 6/1982 | Schreiner | |
| 4,575,164 A | * | 3/1986 | Pinnow et al. | 211/126.15 |
| 4,725,066 A | * | 2/1988 | Nootenboom et al. | 211/126.15 |
| 5,979,338 A | * | 11/1999 | Salmanson et al. | 108/55.1 |

FOREIGN PATENT DOCUMENTS

| | | | | |
|---|---|---|---|---|
| DE | 3126092 A1 | * | 1/1983 | A47B/96/02 |
| DE | 299 24 327 U1 | | 10/2002 | |
| FR | 2567730 A1 | * | 1/1986 | A47B/49/00 |
| GB | 312123 | | 2/1928 | |

* cited by examiner

*Primary Examiner*—Jose V. Chen
(74) *Attorney, Agent, or Firm*—Young & Thompson

(57) ABSTRACT

A pallet system includes a pallet and a support of two parallel opposed horizontal rails, open towards each other and spaced to receive opposed side edge portions of a pallet moved in a horizontal plane between the rails. The pallet bears on substantially the full length of the lower flanges in a stowed position and is prevented from significant upward movement by the upper flanges. The upper flanges are cut away at one end to expose to view from overhead the corresponding ends of the lower flanges, so that a pallet can be lowered to rest two of its corners on the exposed ends of the lower flanges and thus be located before horizontal movement into the stowed position.

10 Claims, 5 Drawing Sheets

PALLET SYSTEM

BACKGROUND OF THE INVENTION

This invention concerns a pallet system.

When pallets are transported, they cannot necessarily rely on their own weight and that of the load that they carry to keep them fixed. They have to be constrained in some way. Traditionally, they have been lashed down by ropes, wires or chains, but those take time to set up and undo, and they are wasteful of space since there has to be room around the pallet. Also, loaded pallets cannot be directly stacked one on another.

It is therefore desirable to close pack the pallets in racks, but just placing them on shelves does not solve the problem. They have to be held down in transit, and it is aim of this invention to keep pallets secure in a compact arrangement, and yet easy to load and unload.

SUMMARY OF THE INVENTION

According to the present invention there is provided a pallet system comprising a pallet and a support therefor, the support comprising two parallel opposed horizontal rails of channel section, open towards each other and spaced to receive opposed side edge portions of a pallet moved in a horizontal plane between the rails, the pallet bearing on substantially the full length of the lower flanges in a stowed position and there being prevented by the upper flanges from significant upward movement, the upper flanges being cut away at one end to expose to view from overhead the corresponding ends of the lower flanges, so that a pallet can be lowered to rest two of its corners on the exposed ends of the lower flanges and thus be located before horizontal movement into the stowed position.

Preferably, the upper flange cutaways are angled to create convergent guide edges, and the pallet may then have, on its upper side, an upstand inset from the edge of each side to co-operate with the free edges of the upper flanges. These upstands first meet the angled guide edges so that the pallet is centered by a funelling action as it is moved towards the stowed position, and then the parallel portions of the free edges of the upper flanges maintain the pallet centred.

The rails can also be equipped with guides to centre the pallet as its corners are lowered onto the exposed ends of the lower flanges.

BRIEF DESCRIPTION OF THE DRAWINGS

For a better understanding of the invention, some embodiments will now be described, by way of example, with reference to the accompanying drawings, in which.

DESCRIPTION OF THE PREFERRED EMBODIMENTS

Figure 1:
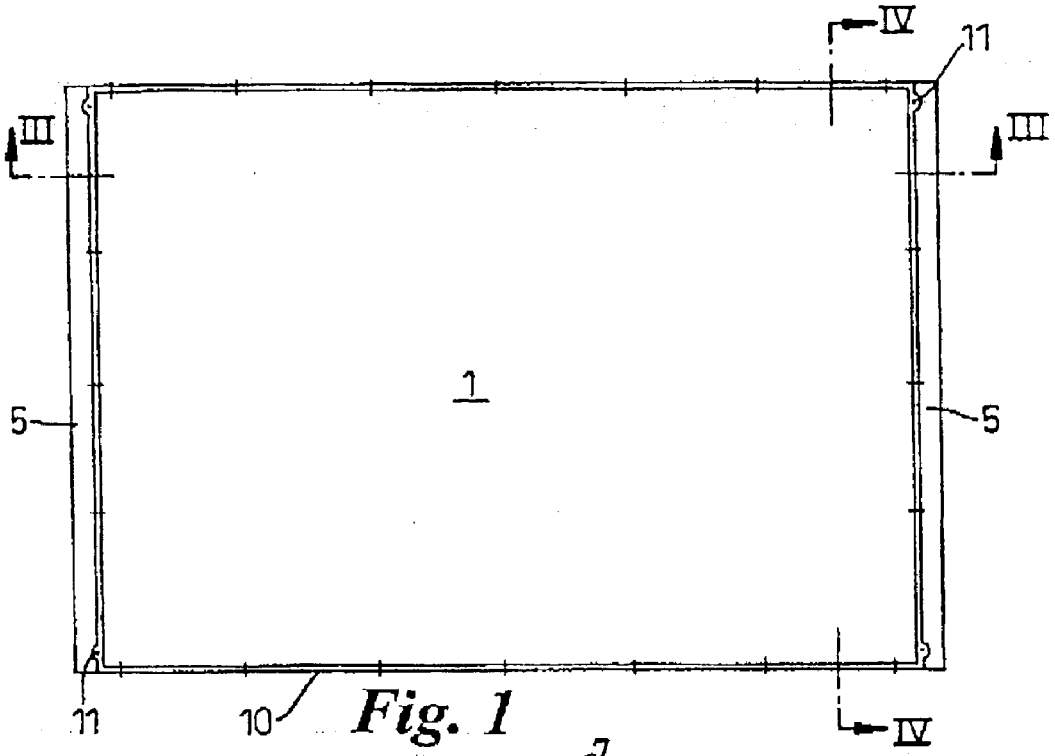
FIG. 1 is a plan view of a pallet.
Figure 2:
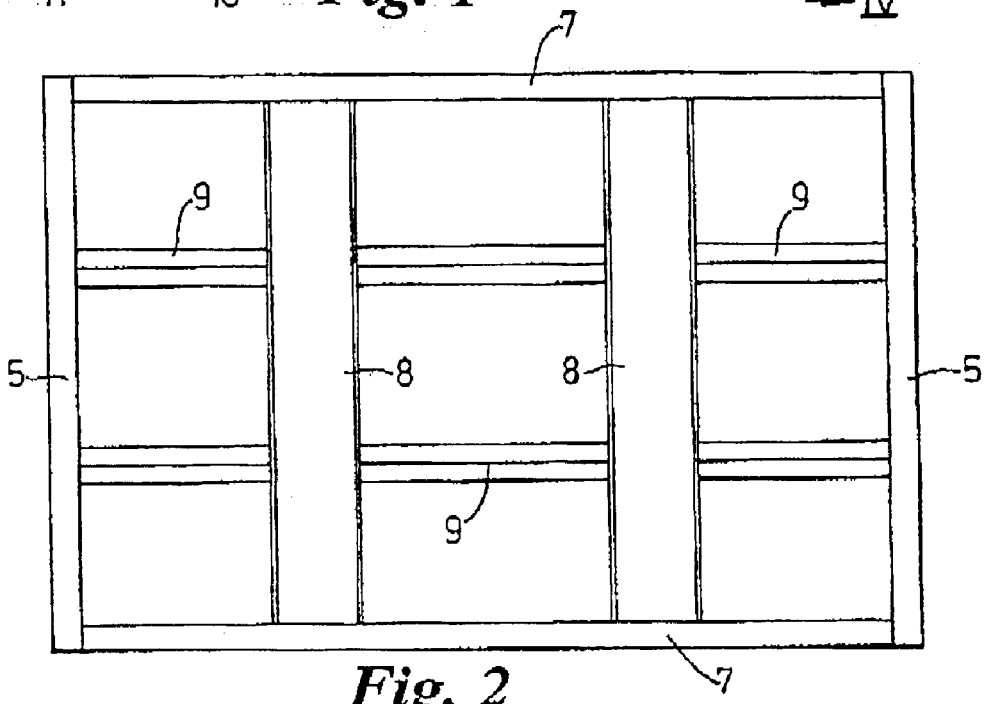
FIG. 2 is an underneath plan view of the pallet.
Figure 3:
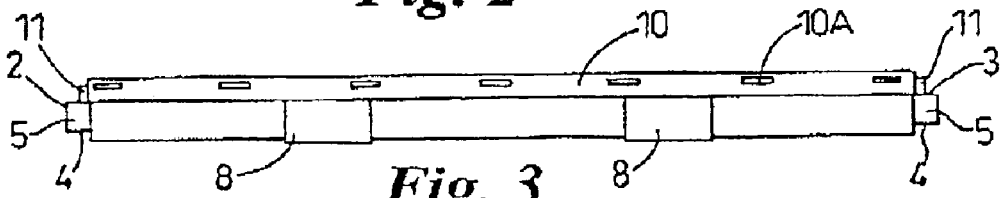
FIG. 3 is a section on the line III—III of FIG. 1.
Figure 4:
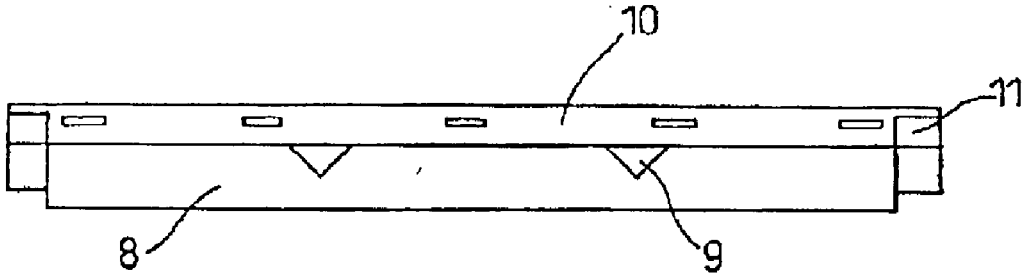
FIG. 4 is a section on the line IV—IV of FIG. 1.
Figure 5:
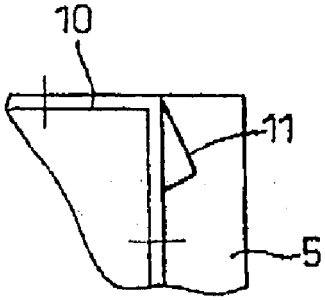
FIG. 5 is an enlarged detail of FIG. 1.

The pallet of FIGS. 1 to 4 is rectangular in plan view and has a flat platform 1 supported by a peripheral frame including inverted L-section members 2 and 3 whose horizontal flanges extend outwardly. The side members 2 are augmented by further L-section members 4 welded on to create box-section ribs 5, and likewise the transverse members 3 are augmented by L-section members 6 to make box-section ribs 7. Underneath the platform 1, there are two parallel box-section beams 8 extending between and through the ribs 7 so that their open ends can receive the forks of a lifting truck. Reinforcing ribs 9 of V-section extend transversely between these beams 8, and between the beams 8 and the side ribs 5. Around the platform 1 there is a low rail or pierced fence 10 which at the sides are set back in from the outer edges of the ribs 5 but whose transverse portions are flush with the outsides of the ribs 7.

Guide elements 11 are provided at the corners of the pallet, on top of the ribs 5. These are short lengths of L-section whose flanges are vertical and which are welded so that the free end of the larger flange goes right to the associated corner of the fence 10, while the free edge of the shorter flange is a short distance along the fence from the corner. These Form wedges which assist in locating the pallet as described below.

Figure 8:
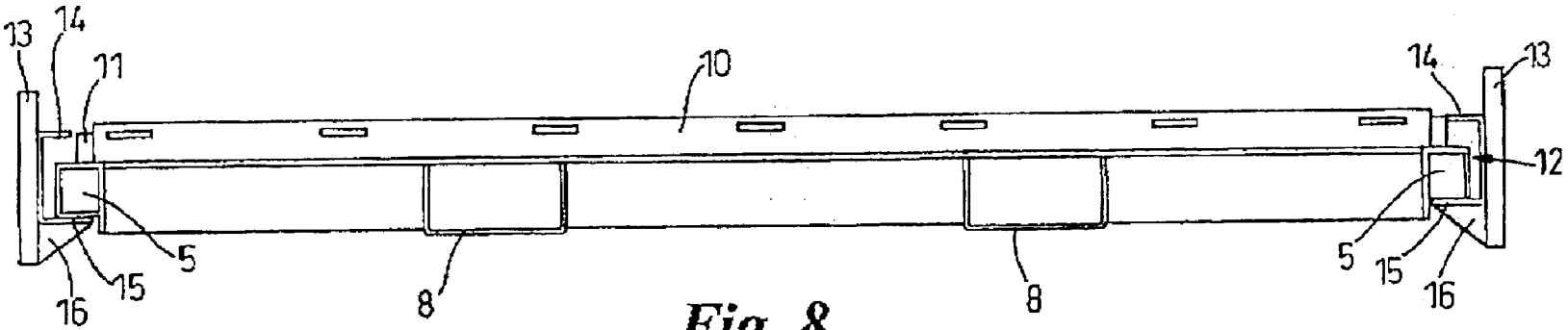
FIG. 8 is a cross-section similar to FIG. 3 showing the pallet supported at its sides by rails.
Figure 9:
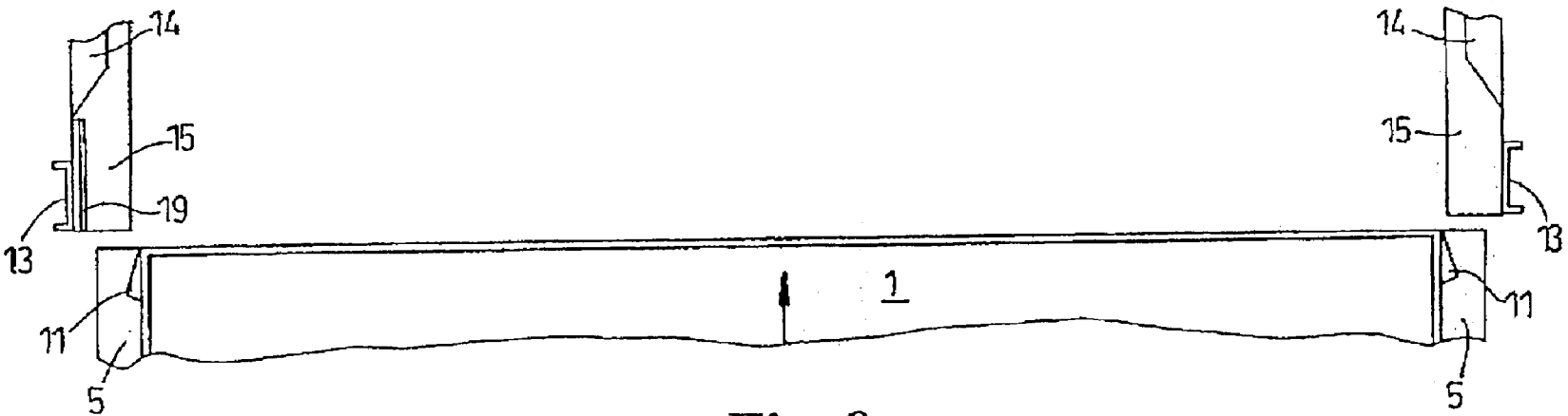
FIG. 9 is a plan view showing part of a pallet approaching co-operation with the rails.

The support for such a pallet is provided by two parallel opposed rails 12. These are of channel-form and secured horizontally to a framework 13 so that the channels are open towards each other. The upper flange 14 is smaller than the lower flange 15, to which additional support is provided by gussets 16. As can be seen from FIG. 8, the lower flanges 15 carry the pallet by the side ribs 5, while the upper flanges 14 overhang those ribs, and prevent significant upward movement of the pallet. However, there is plenty of clearance so that moving the pallet between the rails is not going to be impeded.

Figure 10:
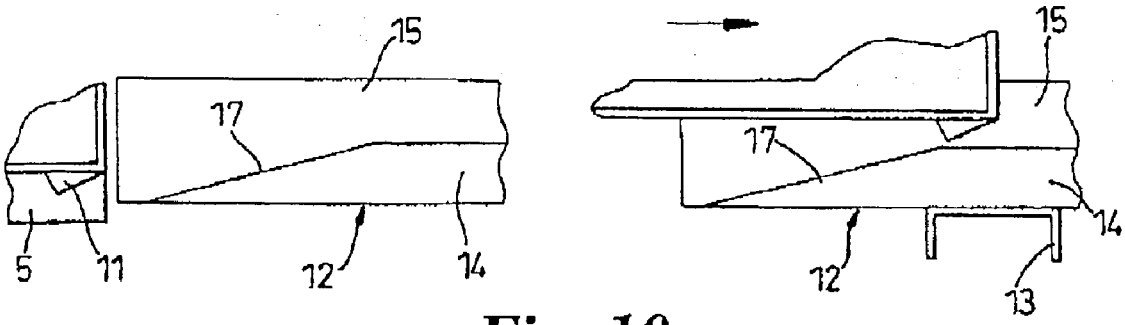
FIG. 10 shows two details, one being similar to part of FIG. 9 and the other showing a subsequent position of the pallet.

Provision is made for locating a pallet at the entrance to the rail channels before it is slid horizontally into place. At this entrance, the upper flanges 14 are cut away either from almost right at the end at a very acute angle, as shown by 17 in FIG. 10, or in the manner of FIG. 11 where the upper flange 14 is completely removed over a short distance over the lower flange and then is angled more steeply than in FIG. 10, as shown by 18. These edges 17 and 18 create convergent guides. A pallet can be lowered so that two corners come to rest on the fully exposed ends of the lower flanges, and then when moved in the direction of the arrows of FIGS. 10 and 11, the pallet is automatically centred by the guide elements 11 meeting the angled edges 17 or 18.

Figure 6:
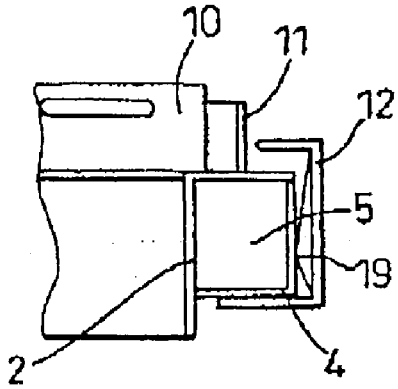
FIG. 6 is an enlarged detail of FIG. 3, also showing a support rail.
Figure 7:
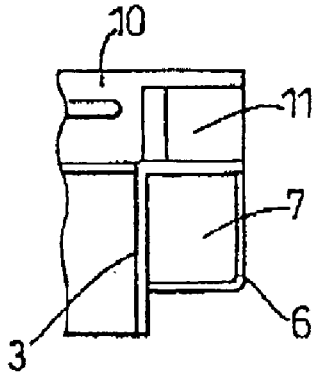
FIG. 7 is an enlarged detail of FIG. 4.
Figure 11:
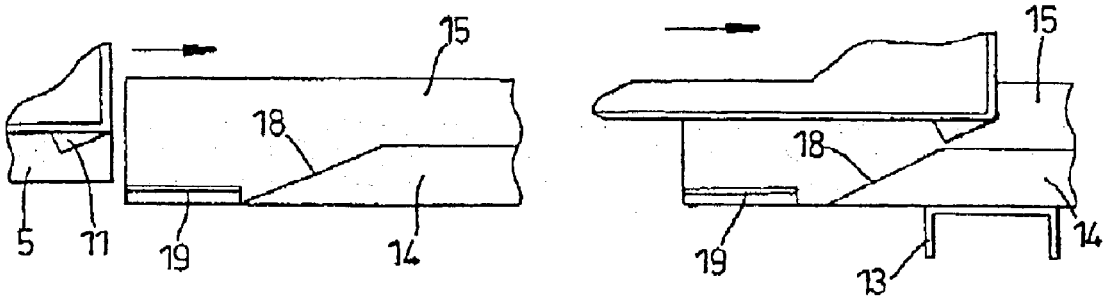
FIG. 11 is similar to FIG. 10 but with a different rail.
Figure 12:
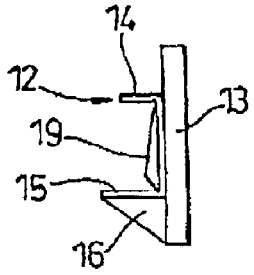
FIG. 12 is an end view of the rail of FIG. 11.

As further assistance in preliminary location of the pallet, the vertical webs of the rails 12 can have wedge elements 19 fitted on the inside at the entry end as shown in FIGS. 6, 11 and 12. These will nudge any lower outer corner of a side rib 5 that might stray too far to one side when being offered up to correct the alignment of the pallet.

Normally, the rails will be enterable from one end only. However, it is possible that they could be enterable from either end, the framework 13 being an "island". In that case, the upper flanges 14 will be cut away at both ends.

There are various ways of trapping a pallet between the rails so that it cannot slide out horizontally, but none are shown for simplicity. Generally, it just requires some form of gate or obstruction to be fixed across the ends of the rail channels or across the gap between the rail ends.

Figure 13:
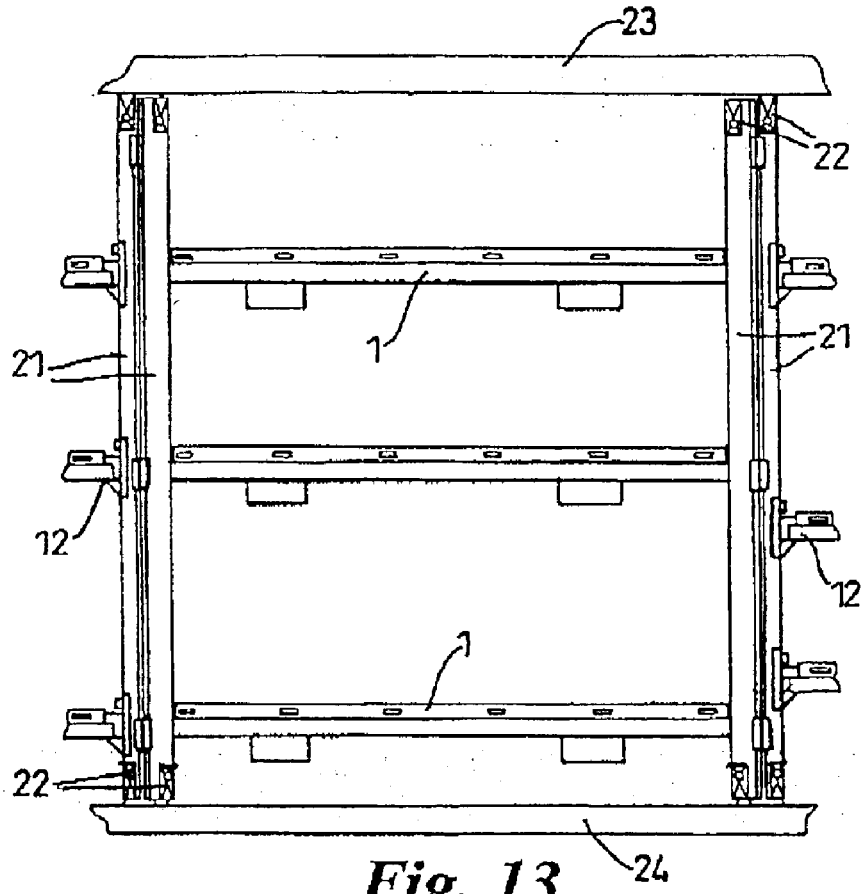
FIG. 13 is a front elevation of part of a rack for stowing a plurality of pallets.
Figure 14:
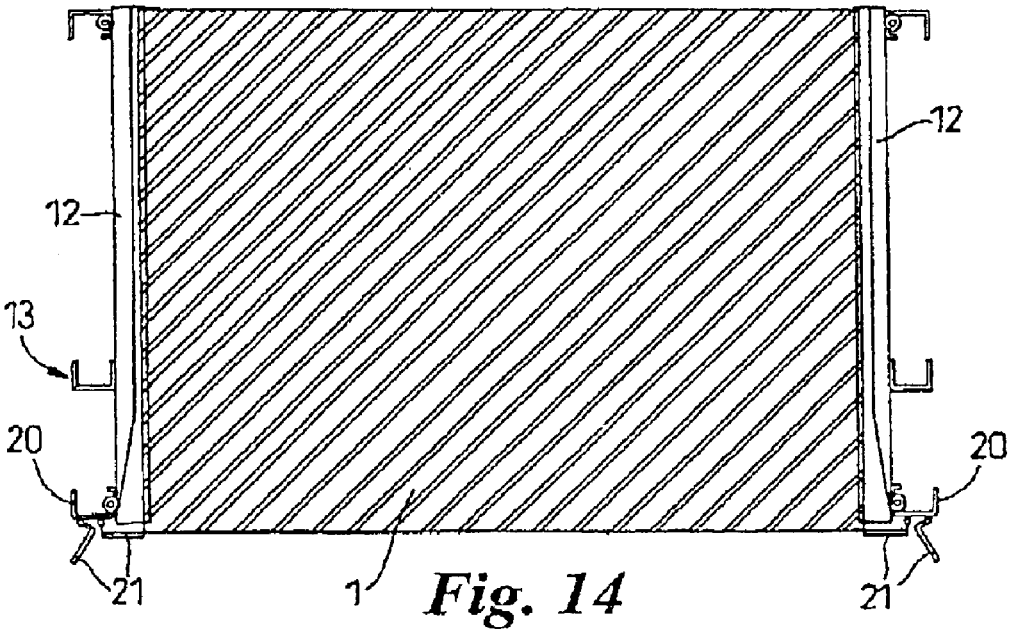
FIG. 14 is a horizontal cross-section of part of the rack of FIG. 13.

FIGS. 13 and 14 illustrate one possible arrangement for a framework or rack 13 that has several sets of rails 12 one above the other in one bay and similar sets of rails in adjacent bays either side, the latter not being shown in full.

The exposed face of each upright 20 at the front of the framework, defining a division between bays, has two L-section flaps 21 hinged thereto extending over the full length of the upright. They are side-by-side and back-to-back, the hinging being along the edges of the narrower flanges so that the wider flanges can each be swung between a position blocking the adjacent ends of the rails 12 (as shown for the central bay) and a position projecting outwardly from the upright 20 where they do not obstruct any rails (as shown for the lateral bays). At the top and bottom of each wider flange, on the convex side of the L, there are spring-loaded bolts 22 which will automatically snap into associated detents in the top and bottom sills 23 and 24 of the framework 13 when the flaps are closed. These may be linked so that a common actuation can release both bolts on one flap simultaneously.

This arrangement allows for re-setting the heights of the rails 12 without the need to attend to this safety measure.

The width of the narrow flanges and the spacing of the hinges on each upright can be such that only one flap per upright can be fully opened at any one time.

It will be understood that the framework 13 could provide back-to-back bays instead of or additionally to side-by-side ones. Where the uprights 20 are at corners, they will of course only have one flap 21.

What is claimed is:

1. A pallet system comprising:

a pallet;

guide elements provided at the corners of the pallet; and a pallet support, the support comprising two parallel opposed horizontal rails of channel section, open towards each other and spaced to receive opposed side edge portions of a pallet moved in a horizontal plane between the rails, the rails comprising upper flanges and lower flanges, the rails comprising guides that interact with guide elements to center the pallet on the pallet support, the pallet bearing on substantially a full length of the lower flanges in a stowed position and there being prevented by the upper flanges from significant upward movement, the upper flanges being cut away at one end to expose to view from overhead the corresponding ends of the lower flanges, so that a pallet can be lowered to rest two of its corners on exposed ends of the lower flanges and thus be located before horizontal movement into the stowed position, wherein, the pallet is automatically centered by the guide elements interactively meeting the guides of the rails.

2. A pallet system comprising a pallet and a support therefor, the support comprising two parallel opposed horizontal rails of channel section with upper and lower flanges, the rails open towards each other and spaced to receive opposed side edge portions of a pallet moved in a horizontal plane between the rails, the pallet bearing on substantially a full length of the lower flanges in a stowed position and there being prevented by the upper flanges from significant upward movement, the upper flanges being cut away at one end to expose to view from overhead the corresponding ends of the lower flanges, so that a pallet can be lowered to rest two of its corners on exposed ends of the lower flanges and thus be located before horizontal movement into the stowed position, wherein the upper flange cutaways are angled to create convergent guide edges.

3. A pallet system according to claim 2, wherein the pallet has, on its upper side, an upstand inset from an edge of each side to co-operate with free edges of the upper flanges.

4. The system of claim 1, wherein the guide elements are provided on the corners of the pallet on top of rib portions.

5. The system of claim 4, wherein the guide elements and rib portions form wedges that locate the pallet on the pallet support.

6. The system of claim 1, wherein the guides on the rails comprise angled edges so that in lowering the pallet, the two pallet corners come to rest on the exposed ends of the lower flanges, and, when moved in the horizontal direction, the pallet is automatically centered by the guide elements meeting the angled edges.

7. A pallet system comprising:

a pallet with opposed side edge portions; and a support supporting the pallet, the support comprising lower flanges, upper flanges, two parallel opposed horizontal rails of channel section, open towards each other and spaced to receive the pallet's opposed side edge portions moved in a horizontal plane between the rails, the pallet bearing on substantially a full length of the lower flanges in a stowed position, significant upward movement of the pallet being prevented by the upper flanges, the upper flanges being cut away at one end to expose to view from overhead corresponding ends of the lower flanges so that a pallet can be lowered to rest two of its corners on exposed ends of the lower flanges and thus be located before horizontal movement into the stowed position, and guides located on the rails in a position to centre the pallet as its corners are lowered onto the exposed ends of the lower flanges.

8. The system of claim 7, wherein guide elements are provided at the corners of the pallet.

9. The system of claim 8, wherein the guide elements assist in locating the pallet on the pallet support.

10. The system of claim 8, wherein the guides on the rails comprise angled edges so that in lowering the pallet, the two pallet corners come to rest on the exposed ends of the lower flanges, and, when moved in the horizontal direction, the pallet is automatically centered by the guide elements meeting the angled edges.

* * * * *